US005316410A

United States Patent [19]

Blume

[11] Patent Number: 5,316,410

[45] Date of Patent: May 31, 1994

[54] FOUNDATION DRAINAGE SYSTEM

[76] Inventor: Robert F. Blume, 111 Cliffwood Ct., East Peoria, Ill. 61611

[21] Appl. No.: 896,528

[22] Filed: Jun. 9, 1992

[51] Int. Cl.[5] ..... E02B 11/00

[52] U.S. Cl. ..... 405/45; 405/38; 405/50; 405/36

[58] Field of Search ..... 405/36, 43, 42, 45, 405/50, 37, 38, 39, 40, 41, 44, 51; 52/169.5

[56] References Cited

U.S. PATENT DOCUMENTS

| | | | |
|---|---|---|---|
| 106,709 | 8/1870 | McMillan | 405/43 |
| 3,563,038 | 2/1971 | Healy et al. | 405/45 |
| 3,656,268 | 4/1972 | Murati | 405/36 X |
| 3,965,686 | 6/1976 | Saito et al. . | |
| 4,246,305 | 1/1981 | Delattre . | |
| 4,538,386 | 9/1985 | DiCello . | |
| 4,733,989 | 3/1988 | Harriett . | |
| 4,810,573 | 3/1989 | Harriett . | |
| 4,820,080 | 4/1989 | Várkonyi et al. | 405/36 X |
| 4,840,515 | 6/1989 | Freese . | |
| 4,869,032 | 9/1989 | Geske . | |
| 4,907,385 | 3/1990 | Biodrowski | 405/45 X |
| 4,923,331 | 5/1990 | Kreikemeier | 405/43 X |
| 4,930,272 | 6/1990 | Bevilacqua . | |
| 5,017,042 | 5/1991 | Minor et al. . | |

FOREIGN PATENT DOCUMENTS

| | | | |
|---|---|---|---|
| 794744 | 12/1935 | France | 405/45 |
| 2-285115 | 11/1990 | Japan | 405/36 |
| 74271 | 11/1948 | Norway | 405/36 |
| 1032118 | 7/1983 | U.S.S.R. | 405/45 |
| 1418406 | 8/1988 | U.S.S.R. | 405/43 |

OTHER PUBLICATIONS

"Enkadrain" foundation drainage sheeting, 02710/AKZ, Buyline 1779.

"J. Drain subsurface drainage layer", 300 Series.

*Primary Examiner*—Randolph A. Reese
*Assistant Examiner*—J. Russell McBee
*Attorney, Agent, or Firm*—Pennie & Edmonds

[57] ABSTRACT

This invention relates to the draining of foundations by using an elongate subterranean drainage structure located approximately horizontally and parallel to the foundation in combination with a plurality of elongate upwardly extending hollow drain structures extending from the structure toward the surface of the earth. Hydrostatic pressure of water in the soil forces water through holes in the upwardly extending drain structures. The water then passes rapidly to the bottom of the upwardly extending drain structures by the force of gravity and thereupon into the horizontal drain structure wherein it is carried away from the foundation.

23 Claims, 4 Drawing Sheets

FOUNDATION DRAINAGE SYSTEM

TECHNICAL FIELD

The present invention relates to an apparatus for improved subterranean foundation drainage of particular use for buildings. More particularly this invention relates to an apparatus for allowing water or other liquids in soil to accumulate in hollow, upwardly extending members, to travel by gravity down these members, to pass into an approximately horizontal drain means and from there to travel by gravity into a storm drain system.

BACKGROUND OF THE INVENTION

Drainage systems are often installed to prevent water from accumulating in the soil near foundations of buildings. This water, acting under hydrostatic pressure, is forced through small gaps in the foundation wall and enters the building.

A common method to prevent this is to place an approximately horizontal drain external to and near the base of a foundation wall to channel water away from the foundation and thus relieve the hydrostatic pressure and consequent leakage.

This method reduces the hydrostatic pressure in the soil near the horizontal drain. It does not provide effective protection from water which permeates the soil from above, however, since this water percolates downward from the surface of the ground to the bottom of the foundation before it enters the drainage system. While percolating downward, this surface water saturates the soil and applies hydrostatic pressure on the upper foundation walls before it reaches the drainage system at the bottom of the foundation.

Another method for preventing foundation leaks is to coat the outer surface of the foundation with a sealant that prevents water in the saturated soil from forcing its way into the building. These sealants are fragile and are often damaged when installed or degrade after installation.

Drainage systems have been devised providing a sheet-like barrier covering the buried outer face of a foundation wall. Typical sheet systems are disclosed in U.S. Pat. Nos. 4,840,515, 3,965,686, 4,810,573, and 4,733,989.

Such sheet systems typically have interior voids between an inner sheet and a permeable outer sheet allowing water to leave the soil, pass into the voids, and flow by gravity downward into the horizontal drainage tube. Such systems are difficult and expensive to install, as the entire subterranean foundation wall is typically covered from near the surface of the ground to the horizontal drainage tube.

Other drainage systems (such as U.S. Pat. Nos. 4,930,272 and 4,869,032, below) channel water from between the walls of a foundation into a horizontal drain located inside the building and underneath a basement slab. For example, DiCello, U.S. Pat. No. 4,538,386, describes a drainage system comprised of horizontal drain pipes laid both outside the foundation wall and inside (within the foundation boundaries) the foundation walls, The internal drain pipes connect to the interior of a foundation wall and allow water to drain therefrom.

Many other devices are known in the art for soil drainage in general. For example, Delattre, U.S. Pat. No. 4,246,305, describes an extruded multichannel porous drainage strip for placing in water filled soil. There are also devices for forming a solid wall of backfilled material around a foundation, thus providing a porous path for downward water percolation. Minor et al., U.S. Pat. No. 5,017,042, describe a biodegradable accordion-like container for holding a layer of such coarse drainage material vertically against a foundation wall while the gap between the foundation and the excavation is backfilled.

SUMMARY OF THE INVENTION

It is therefore an object of this invention to provide a durable and inexpensive drainage system for draining soils near a subterranean foundation.

It is another object of this invention to provide a drainage system that is not subject to clogging.

It is a further object of this invention to provide a drainage system that is installed relatively inexpensively and easily.

It is a further object of this invention to provide a flexible drainage system that tailors drainage capacity and cost to the particular soil and rainfall conditions of the particular foundation and weather.

The present invention achieves these and other objects by providing a drainage system capable of easy installation and tailorable to a variety of soils and rainfall conditions. The drainage system combines an approximately horizontal drainage means or tiling in combination with upwardly extending hollow risers that direct water in the soil downwardly into drainage o tubes and away into storm or sanitary drains. The horizontal drainage means is not truly horizontal, since a slight incline must be provided to insure that water flows down the drainage means. The hollow risers are mounted adjacent to the face of the foundation wall and provide a downward channel for water that accumulates on the surface and penetrates the upper layers of soil above the drainage tube. The hollow risers are perforated, typically on the side facing away from the foundation, allowing water in the surrounding soils to enter. These perforations may be covered with a filter medium, typically landscaping cloth, fiberglass or mesh screen, to prevent dirt, gravel and silt from filling up the hollow riser and the drainage tube.

The lower ends of the hollow risers may be directly connected to the horizontal drainage tube. A "T" connection may be used to join the drainage tube and the hollow risers. The risers may abut the drainage tube, as well. In another embodiment the lower ends of the risers are spaced a short distance from the drainage tube. In a further embodiment the lower end of the risers abut the drainage tube.

DESCRIPTION OF THE PREFERRED EMBODIMENTS

Figure 1:
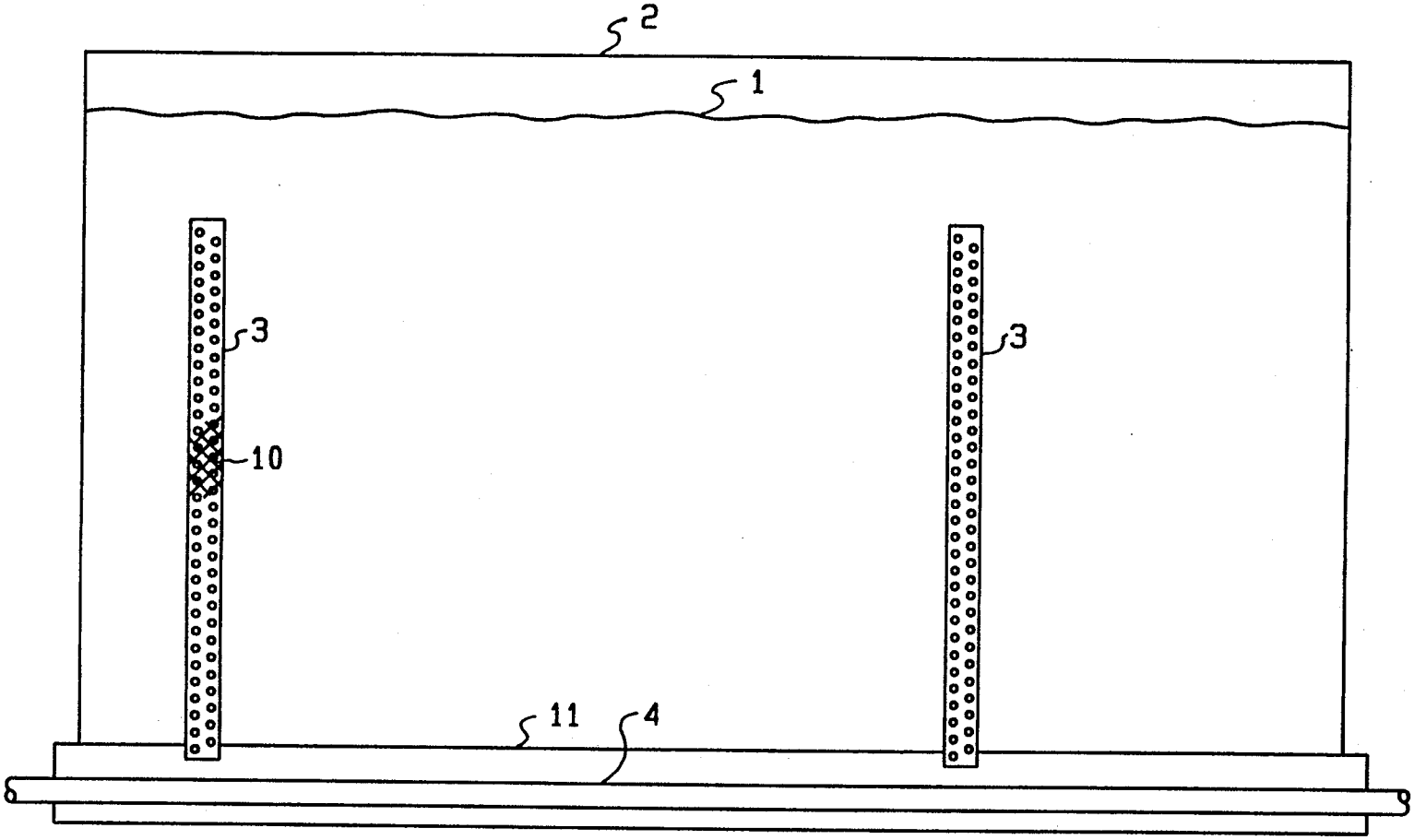
FIG. 1 is a side elevation view of the present invention, through the earth surrounding the foundation.

Referring to FIG. 1, means for draining the soil, such as drainage tube 4, extends approximately horizontally along foundation 2 near footing 11 and is underneath the surface 1 of the earth abutting the foundation 2. The means for draining is actually slightly inclined from horizontal to provide a slight angle to lead the water toward the outlet of the drainage system; however, it is generally horizontal as compared to the hollow riser 3 to be described. Any material forming a channel for downward water flow is acceptable, such as plastic, clay, ceramic, gravel or other media.

Figure 2:
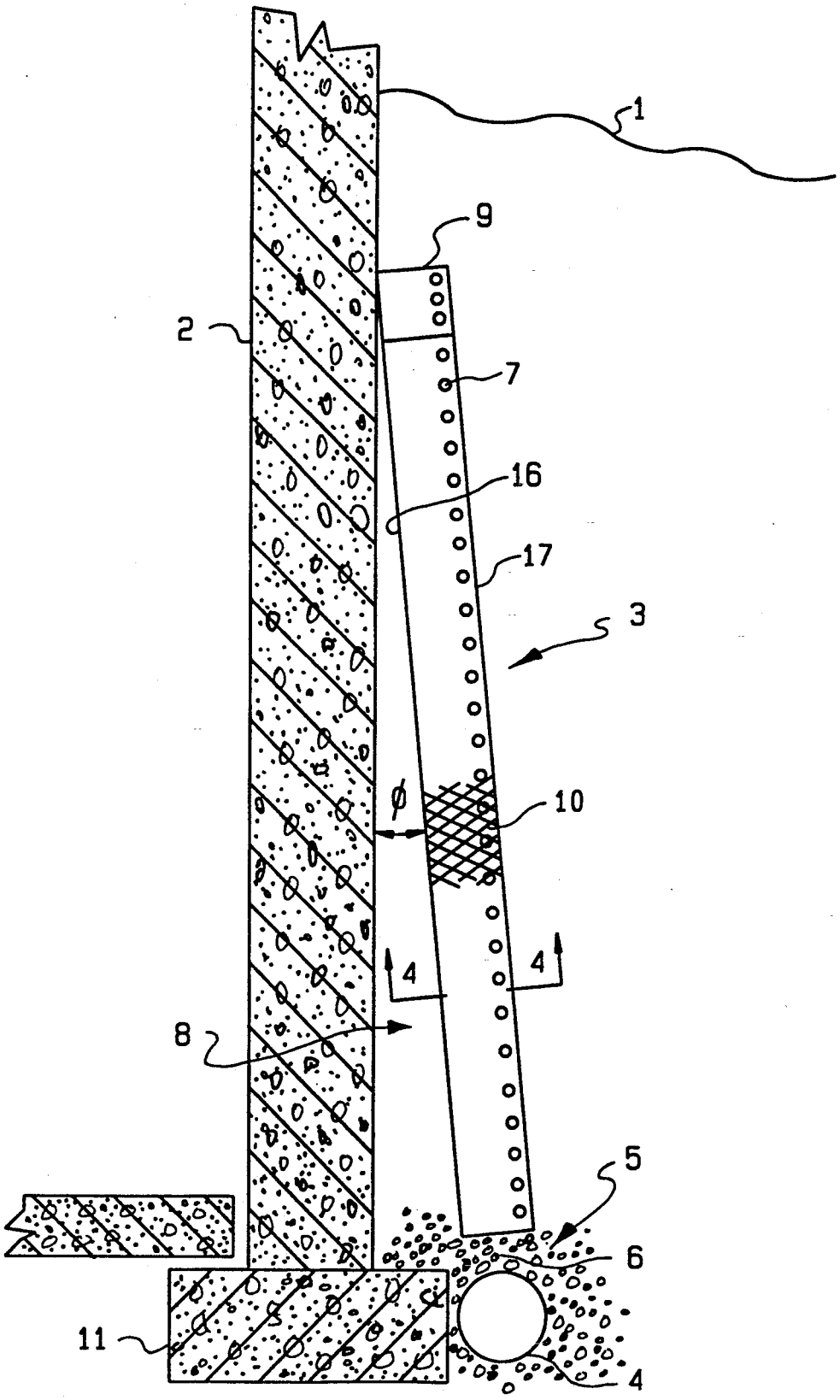
FIG. 2 is a side sectional view of the embodiment of the invention shown in FIG. 1 with soil removed.

According to the present invention, a plurality of hollow risers 3 extend upwardly from tube 4. In this embodiment these risers are made of PVC drain pipe, preferably about 4" in diameter, although sizes ranging from about 2" to 8" in diameter are effective for a typical house foundation. Referring to FIG. 2, riser 3 extends upwardly from tube 4 creating an angle $\phi$ of 0 to 20 degrees with the foundation wall 2. Preferably angle $\phi$ is between about 3 and 10 degrees and most preferably about 5 degrees. This angle defines a void 8 between the riser and the foundation.

Figure 4:
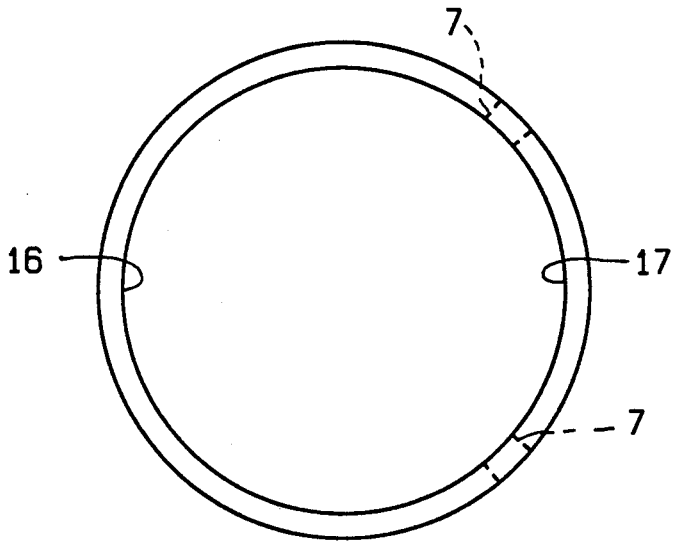
FIG. 4 is a cross-section of an embodiment of the hollow riser, viewed through line 4—4 in FIG. 2.

At the top of each riser 3, means for covering the upper end to prevent the entry of soil, such as cap 9, may be disposed. In this embodiment the cap is made of landscaping cloth. Numerous other methods of covering the end of the riser to prevent dirt from entering are acceptable, such as a pipe cap, a "T" joint or fiberglass. The advantage to landscaping cloth and fiberglass is that these materials pass water relatively easily, yet resist the passage of dirt. Each riser is perforated with holes 7 passing through from the outside to the inside surface of the riser. In a preferred configuration, the holes are approximately 9/16" in diameter, spaced approximately 4" apart and located in two longitudinal rows. In this embodiment, illustrated in FIG. 4, the holes 7 are located in two rows on the earth-facing side 17 of the riser, and the riser has a smooth foundation-facing side 16. This foundation-facing surface provides a smooth imperforate channel for water to flow down the riser. Other spacings or diameters may be used depending on the requirements of the system. For example, closer spacing could be used to increase water flow into the risers.

A filtering means such as screen 10 (shown only partially) covers the holes in the riser. This filtering means should be such that it allows water to pass from the soil to the interior of the riser, yet inhibits the passage of the soil itself. Again, landscaping cloth is a preferred material. At the bottom of the riser is a gap 6 between riser 3 and tube 4. This gap is typically about 4" to 12" in height, most typically about 9". Gap 6 is filled with backfill material 5, such as pea gravel, which allows water to pass through relatively easily, yet inhibits the passage of dirt or other particulate matter.

When riser 3 and tube 4 are covered with backfill, the void 8 defined by the angle $\phi$ between riser 3 and wall 2 is loosely filled with backfill material. This void provides an additional channel to o move water away from the wall 2 toward riser 3 and into drainage means 4.

As shown in FIG. 1, risers 3 are spaced apart from each other. Typical spacing varies from 4' to 12 feet depending upon the soil type and water conditions, with closer spacings used in problem drainage areas such as especially wet soils, clay-based soils, or grades that tend to direct surface water toward a foundation rather than away from it. Risers smaller than 4" in diameter may require a closer spacing to provide enough drainage. An 8' spacing with risers 4" in diameter is effective for most soil and water conditions.

In use, water entrained in the soil is forced through a filter screen 10 and through holes 7 into the hollow riser 3 by hydrostatic pressure. Referring to FIG. 2, riser 3 is at an angle $\phi$, and since the earth-facing side 17 of riser 3 is perforated and the foundation-facing side 16 is not, water entering the holes 7 flows inside the riser to the foundation-facing side 16 and then down a longitudinal channel formed by the non-perforated side 16 to the bottom of the riser. It then travels through the filter of backfill 5 in gap 6 and enters the drainage tube 4. It travels down the drainage tube and typically enters a storm or sanitary drain.

Figure 3:
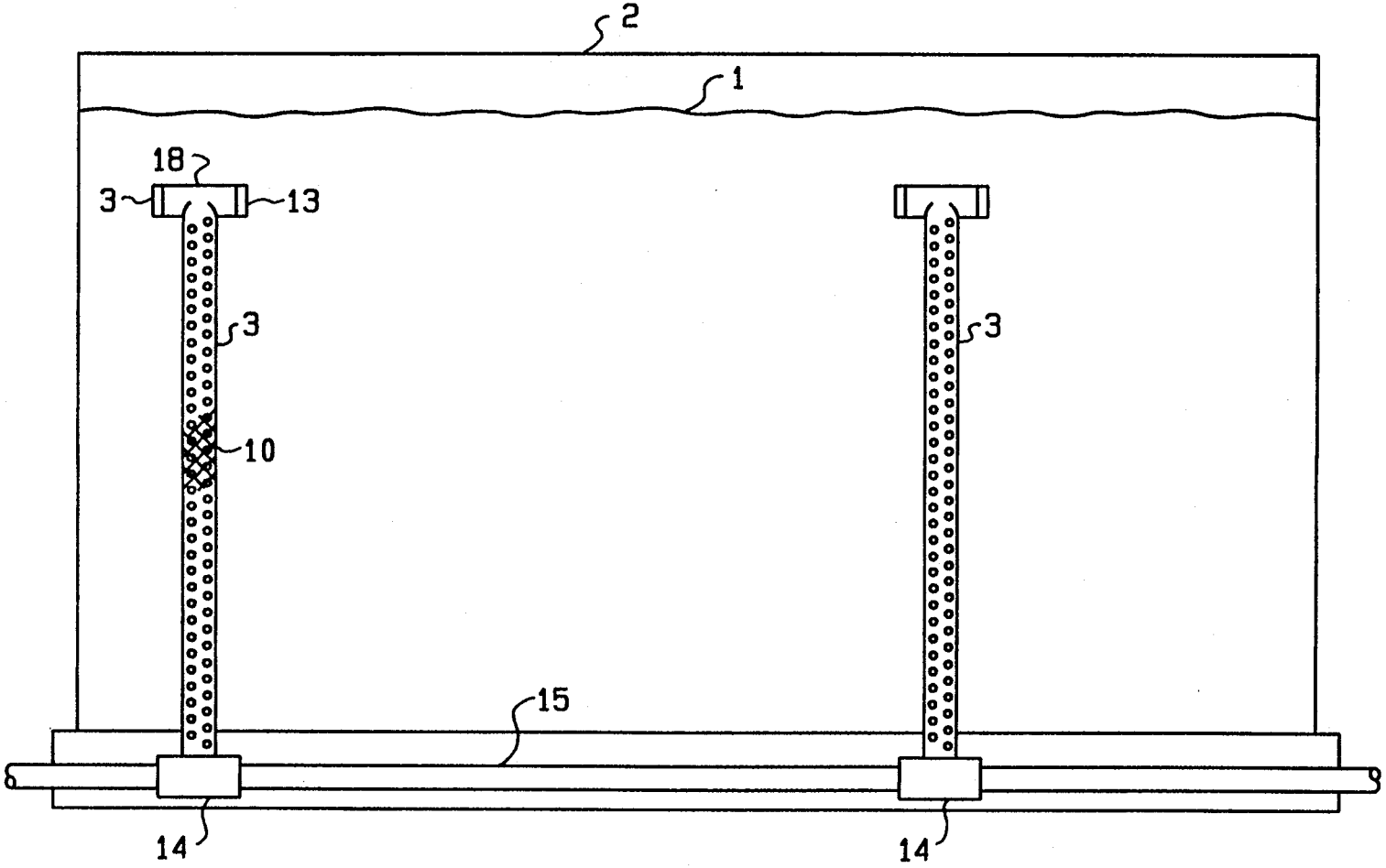
FIG. 3 is a partial elevation of an alternative embodiment of the present invention with soil removed.

FIG. 3 shows a further embodiment of the invention. Cap 18 of hollow riser 3 is oblong, shaped as a "T". An oblong shape prevents the riser from rolling down the wall when placed in position. In this embodiment, cap 18 is also provided with a landscaping cloth cover for the open ends of the "T"s to prevent dirt from entering the riser. Other methods are available to cover the ends of a "T", such as pipe caps or fiberglass, for example. The advantage of landscaping cloth, fiberglass or similar materials, is their porosity to water and relatively impermeability to dirt.

A further feature of this embodiment is the "T" shaped lower end 4 of the hollow riser 3. The drainage tube 15 intersects the "T" shaped lower end 14 of the riser, thus permitting water to travel into the drainage tube directly without passing through an earth filtering gap 6 as embodied in FIG. 2. This "T" shape is provided in this embodiment by attaching a "T" joint to the lower end of riser 3.

Another embodiment of riser 3 has a "T" shaped lower end that is proximate to, but does not intersect, the drainage tube.

What is claimed is:

1. A foundation drainage system for draining water away from foundations buried under a soil surface, the foundation including a foundation wall and foundation footing, said system comprising:

first drain means disposed along the footing for draining water away from the foundation;

second drain means communicating with and extending upward from said first drain means for receiving water and relieving hydrostatic pressure along the wall, said second drain means comprising a plurality of individual, hollow, self-supporting, tubular, members, each member having a first end adjacent to said first drain means and a second end extending generally toward the soil surface and adjacent to the wall, wherein the first end is farther from the foundation wall than the second end so that the members are disposed at an angle to the foundation wall, said members being spaced a predetermined distance apart and defining a plurality of water receiving perforations, whereby hydrostatic pressure along the foundation forces water through the perforations into said hollow members and said water flows into said first drain means and away from the foundation.

2. A foundation draining system for draining water away from foundations buried under a solid surface, the foundation including a foundation wall and foundation footing, said system comprising:

first drain means disposed along the footing for draining water away from the foundation;

second drain means communicating with and extending upward from said first drain means for receiving water and relieving hydrostatic pressure along the wall, said second drain means comprising a plurality of individual, hollow, self-supporting, tubular, members, each member having a first end adjacent to said first drain means and a second end extending generally toward the soil surface and adjacent to the wall, said members being spaced a predetermined distance apart and defining a plurality of water receiving perforations, whereby hydrostatic pressure along the foundation forces water through the perforations into said hollow members and said water flows into said first drain means and away from the foundation, wherein the second end of the hollow members contacts the foundation wall and the first end of the hollow members is spaced away from the foundation wall such that each hollow member is disposed at an angle to the wall.

3. The system according to claim 2, wherein the predetermined distance between said hollow members is at least about 4 feet.

4. The system according to claim 3 wherein said perforations are sized to prevent entry of solid matter into at least one of the hollow members while allowing free flow of water therein.

5. A foundation drainage system for draining water from the soil around a foundation wall and footing, comprising:

means for draining oriented approximately horizontally and adjacent to said foundation wall;

a plurality of hollow, members extending upwardly from said draining means and having a plurality of perforations passing through said hollow members, said members having an upper end disposed near the surface of the earth and proximate to said foundation wall and having a lower end located proximate to said means for draining, wherein said upper end is supported by said foundation wall and said lower end is spaced away from said foundation wall such that said member is disposed at an angle to the wall; and means for covering said upper end of said hollow members.

6. A foundation drainage system for draining water from the soil around a foundation wall and footing, comprising:

means for draining oriented approximately horizontally and adjacent to said foundation wall;

a plurality of hollow, self-supporting, tubular members extending upwardly from said draining means and having a plurality of perforations passing through said hollow members, said members having an upper end disposed near the surface of the earth and proximate to said foundation wall and having a lower end located proximate to said means for draining; and means for covering said upper end of said hollow members;

wherein said hollow members are oriented at an angle of up to about 20 degrees to said foundation wall, with said upper end closer to said foundation wall than said lower end.

7. The foundation drainage system of claim 6, wherein said angle is about 3 to 10 degrees.

8. The foundation drainage system of claim 6, wherein the hollow members have a foundation-facing side and an earth-facing side, and said plurality of perforations are disposed only on the earth-facing side of said members.

9. The foundation drainage system of claim 6, wherein said covering means is porous to water.

10. The foundation drainage system of claim 6, wherein said plurality of perforations in said hollow members are covered with a filter medium.

11. The foundation drainage system of claim 10, wherein said filter medium is foundation cloth.

12. The foundation drainage system of claim 10, wherein said filter medium is a mesh screen.

13. The foundation drainage system of claim 6, wherein said lower end of at least one of said hollow members is connected to said draining means.

14. The foundation drainage system of claim 6, wherein said hollow members are separate from the draining means and the upper end of said hollow members are non-circular in cross-section, thereby preventing said hollow members from rolling down the foundation.

15. The foundation drainage system of claim 6, wherein any one of said plurality of hollow members is spaced at least about 4 feet from the next adjacent one of said plurality of hollow members.

16. The foundation drainage system of claim 6, wherein said plurality of hollow members are from 2" to 8" in diameter.

17. A subterranean foundation drainage system buried in soil for draining water from said soil away from around a foundation wall and footing, comprising:

means for draining oriented approximately horizontally and adjacent to said foundation wall;

a plurality of spaced apart hollow members extending upwardly from said draining means, at least one of said members having a first side facing the foundation wall and a second side facing away from the foundation wall, wherein said second side defines a plurality of perforations for the passage of water therethrough and said first side provides an internal longitudinal channel for directing the water along the hollow member, said member further including an upper end disposed toward the surface of the soil and adjacent to the foundation wall and a lower end communicating with said draining means for passage of water therebetween, said lower end being spaced away from the foundation wall such that said at least one member forms an angle of at least about 3 degrees with the foundation wall to define a void between said member and the foundation wall filled more loosely with backfill than surrounding soil thereby creating a further water drainage path away from said foundation wall; and means for preventing soil from entering the upper end of said hollow members.

18. The foundation drainage system of claim 17, wherein the hollow members are spaced at least about 4 feet apart.

19. The foundation drainage system of claim 17, wherein the upper end of said at least one hollow member contacts the foundation wall and has a non-circular cross-section to prevent said hollow member from rolling along the wall during installation.

20. A foundation drainage system for draining water away from foundations buried under a soil surface, the foundation including a foundation wall and foundation footing, said system comprising:

first drain means disposed along the footing for draining water away from the foundation;

second drain means communicating with and extending upward from said first drain means for receiving water and relieving hydrostatic pressure along the wall, said second drain means comprising a plurality of individual, hollow, elongate members, each member having a first end adjacent to said first drain means and a second end extending generally toward the soil surface and adjacent to the wall, said members being spaced a predetermined distance apart and defining a plurality of water receiving perforations, whereby hydrostatic pressure along the foundation forces water through the perforations into said hollow members and said water flows into said first drain means and away from the foundation, wherein the second end of said members contacts the foundation wall and the first end of the members is spaced away from the foundation wall such that the members are disposed at an angle to the wall.

21. The system according to claim 20, wherein the predetermined distance between said hollow members is at least about 4 feet.

22. The system according to claim 21 wherein said perforations are sized to prevent entry of solid matter into the hollow members while allowing free flow of water therein.

23. A foundation drainage system for draining water from the soil around a foundation wall and footing, comprising:

means for draining oriented approximately horizontally and adjacent to said foundation wall;

a plurality of hollow members extending upwardly from said draining means and having a plurality of perforations passing through said hollow members, said members having an upper end disposed near the surface of the earth and proximate to said foundation wall and having a lower end located proximate to said means for draining wherein said hollow riser is oriented at an angle of up to about 20 degrees to said foundation wall, with said upper end closer to said foundation wall than said lower end; and means for covering said upper end of said hollow members.

* * * * *